US005215342A

United States Patent [19]

Yuge et al.

[11] Patent Number: 5,215,342

[45] Date of Patent: Jun. 1, 1993

[54] LOCK STRIKER UNIT WITH COVER

[75] Inventors: Masaaki Yuge; Tatsuyuki Takaishi; Hitoshi Nakamura, all of Yokohama, Japan

[73] Assignee: Ohi Seisakusho Co., Ltd., Yokohama, Japan

[21] Appl. No.: 974,886

[22] Filed: Nov. 12, 1992

[30] Foreign Application Priority Data

Nov. 15, 1991 [JP] Japan ..... 3-326708

[51] Int. Cl.[5] ..... E05C 21/02

[52] U.S. Cl. ..... 292/340; 292/DIG. 38; 292/DIG. 41

[58] Field of Search ..... 70/54, 55, 56, 452; 292/340, 341.14, DIG. 41, 216, 280

[56] References Cited

U.S. PATENT DOCUMENTS 4,651,543 3/1987 Heald et al. ..... 70/54
4,981,313 1/1991 Makamura ..... 292/340
5,046,339 9/1991 Krell ..... 70/55

FOREIGN PATENT DOCUMENTS 2-36573 3/1990 Japan .
2-43167 11/1990 Japan .

*Primary Examiner*—Richard E. Moore
*Attorney, Agent, or Firm*—Foley & Lardner

[57] ABSTRACT

A lock striker unit comprises generally a striker and a plastic cover. The striker includes a base plate, a generally U-shaped rod secured to the base plate and a molded plastic material covering the rod to provide each shank portion of the same with a diametrically larger portion and a diametrically smaller groove portion. The groove portion is positioned near the base plate. The plastic cover is sized to cover a major surface of the base plate and has an elongate slit which is constructed to permit the U-shaped rod to pass therethrough. The elongate slit includes two circular openings connected through a thinner slit. Each circular opening is so sized as to make a latched engagement with the groove portion of the shank portion when the plastic cover is properly attached to the base plate.

13 Claims, 4 Drawing Sheets

LOCK STRIKER UNIT WITH COVER

BACKGROUND OF THE INVENTION

1. Field of the Invention

The present invention relates in general to a lock striker for automotive door lock device, and more particularly to a lock striker unit with a cover.

2. Description of the Prior Art

Some of the lock striker units for automotive door lock device, of the above-mentioned cover-possessed type, are shown in, for example, Japanese Utility Model First Provisional Publication 2-36573 and Japanese Utility Model Second Provisional Publication 2-43167.

The lock striker unit of such type comprises generally a lock striker and a plastic cover. The cover is designed to cover a base plate of the lock striker. Latching pawls are provided around the periphery of the cover, and notches are formed in the base plate of the striker. Upon coupling of the cover and the striker, the latching pawls of the cover are engaged with notches of the base plate to obtain a latched engagement therebetween.

However, due to inherent constructions, these conventional lock striker units have some drawbacks. That is, the latched engagement between the cover and the base plate of the striker is not so strong. Thus, it often happens that the cover gets out of place by only a slight shock applied thereto when, for example, the cover catches the cloth of a passenger who is getting on or off. Furthermore, providing the base plate of the striker with the notches reduces the mechanical strength of the base plate, and thus, that of the striker. Furthermore, some covers of such lock striker units are subjected to have a certain clearance between the cover and the base plate of the striker due to their inherent constructions. In this case, the clearance tends to contain water and dust, which causes not only lusting of the base plate but also lowering of the external appearance.

SUMMARY OF THE INVENTION

It is therefore an object of the present invention to provide a lock striker unit with a cover, which is free of the above-mentioned drawbacks.

According to the present invention, there is provided a lock striker unit with a cover, which can assure a latched engagement between the cover and the base plate of the striker without the aid of notches formed in the base plate.

According to the present invention, there is further provided a lock striker unit with a cover, in which the cover can be readily attached to the base plate of the striker with a simple manual labor work.

According to the present invention, there is provided a lock striker unit with a cover, which has a satisfied external appearance.

According to a first aspect of the present invention, there is provided a lock striker unit for use with a lock device. The lock striker unit comprises a striker including a base plate, a rod having one end secured to the base plate and means for providing the rod with a diametrically larger shank portion and a diametrically smaller groove portion, the groove portion being positioned at the end of the rod; and a resilient cover having a size to cover a major surface of the base plate, the cover having an aperture surrounded by tongue portions defined by the cover, the aperture permitting the rod to pass therethrough and being so sized that when the shank portion is received in the aperture, the tongue portions are resiliently deformed by the shank portion, and when the groove portion is received in the aperture, the tongue portions make a latched engagement with the groove portion.

According to a second aspect of the present invention, there is provided a lock striker unit for use with a lock device. The lock striker unit comprises a striker including a base plate, a generally U-shaped rod having two shank portions secured to the base plate at their leading ends, and covering means for providing each of the shank portions with a diametrically larger portion and a diametrically smaller groove portion, the groove portion being positioned at the leading end; and a resilient cover having a size to cover a major surface of the base plate, the cover having an elongate slit which is constructed to permit the rod to pass therethrough, wherein the elongate slit includes two circular openings connected through a thinner slit and spaced by a distance corresponding to the distance between the shank portions of the rod, each circular opening being surrounded by tongue portions defined by the cover and being so sized that when the diametrically larger portion of the shank portion is received in the circular opening, the tongue portions are resiliently deformed by the shank portion, and when the groove portion of the shank portion is received in the circular opening, the tongue portions make a latched engagement with the groove portion.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Referring to FIGS. 1 to 4 of the drawings, there is shown a first embodiment of the present invention.

Figure 1:
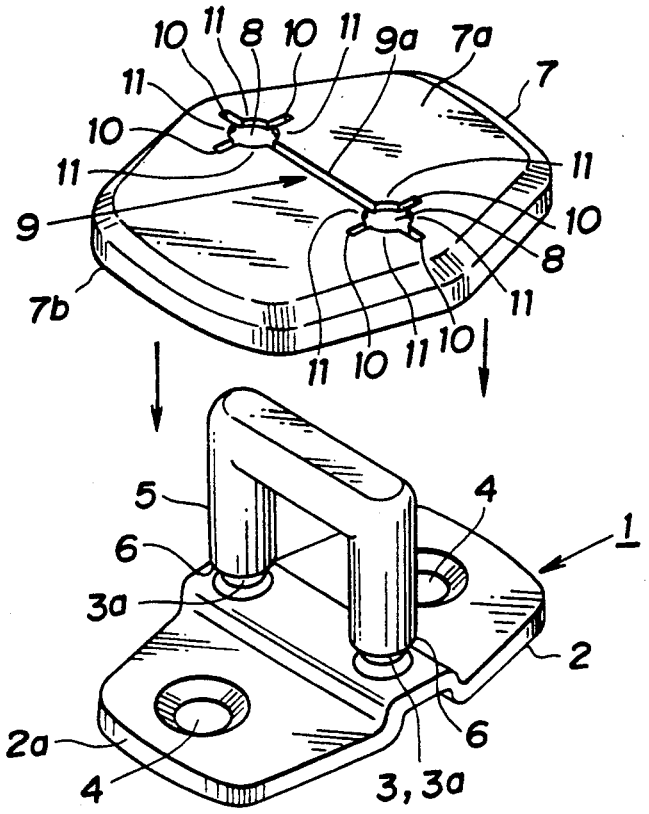
FIG. 1 is a perspective view of a first embodiment of the present invention, showing a condition wherein a cover and a lock striker are separated.
Figure 3:
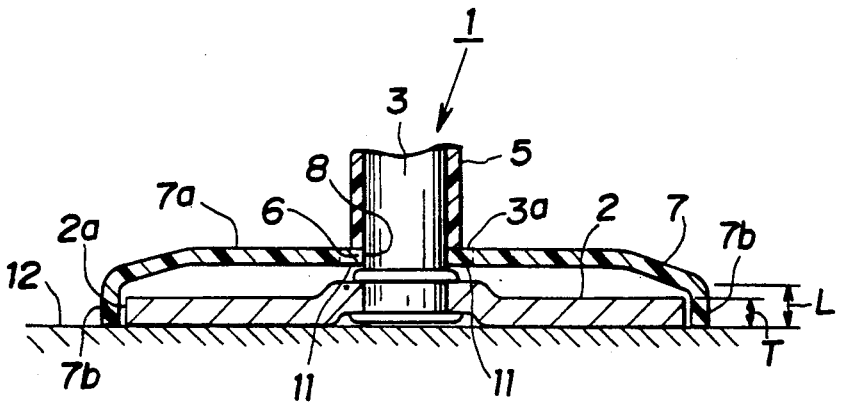
FIG. 3 is a sectional but partial view taken along the line III—III of FIG. 2.

In these drawings, particularly FIG. 1, denoted by numeral 1 is a lock striker which is usually mounted to a vehicle body 12 (see FIG. 3). The lock striker 1 comprises a base plate 2 which is bolted to the vehicle body, and a generally U-shaped rod 3 which has opposed ends secured to the base plate 2. Although not shown in the drawings, when a door is closed, a latch plate of a door lock device mounted in the door is brought into engagement with the U-shaped rod 3 to latch the door relative to the vehicle body. The base plate 2 has two tapered openings 4 through which connecting bolts (not shown) pass to fasten the base plate 2 to the vehicle body. The U-shaped rod 3 is covered with a plastic rod cover 5 except the opposed end portions 3*a* thereof. Thus, annular grooves 6 are defined at the opposed end portions 3*a* of the rod 3, as shown.

Designated by numeral 7 is a molded plastic cover constructed of a resilient plastic material. The cover 7 comprises generally a major flat portion 7*a* which is sized to entirely cover an upper surface of the base plate 2 of the striker 1 and a side wall portion 7*b* which is sized to cover a peripheral edge 2*a* of the base plate 2. As is seen from FIG. 3, the height "L" of the side wall portion 7*b* is somewhat greater than or equal to the thickness "T" of the peripheral portion of the base plate 2.

Referring back to FIG. 1, the major flat portion 7*a* of the cover 7 is formed with an elongate slit 9. The elongate slit 9 comprises two spaced circular openings 8 which are connected through a thinner slit 9*a*. The two circular openings 8 are spaced by a distance which corresponds to the distance between the two shank portions of the U-shaped rod 5 of the striker 1.

The diameter of each circular opening 8 is substantially equal to that of the end portion 3*a* of the rod 3, and thus smaller than that of the shank portion of the rod 5 which is covered with the rod cover 5.

Each circular opening 8 is formed with three radially extending short slits 10. Thus, as is understood from FIG. 1, each circular opening 8 is surrounded by four tongues 11 defined by the major flat portion 7*a*.

Figure 2:
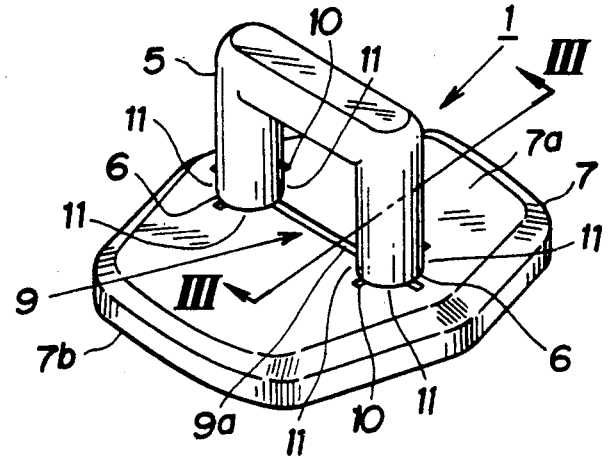
FIG. 2 is a perspective view of the first embodiment, showing a condition wherein the cover is properly attached to the lock striker.

Upon requirement of coupling, the cover 7 is pressed against the striker 1 having the U-shaped rod 5 thrust into the elongate slit 9 thereof. Because the size of the slit 9 is smaller than that of the U-shaped rod 5, the movement of the cover 7 toward the base plate 2 requires a certain force which overcomes a counterforce possessed by the cover 7. That is, during this movement of the cover 7, portions (such as the tongues 11) of the major flat portion 7*a* which surround the elongate slit 9 are resiliently deformed producing such counterforce. When the cover 7 is brought to its proper set position as shown in FIGS. 2 and 3, the tongues 11 of each circular opening 8 of the cover 7, which have been resiliently deformed, are returned to their normal flat positions and latchingly engaged with the corresponding annular groove 6. Thus, the cover can cover the upper surface of the base plate 2 while being latched relative to the same. In this condition, the side wall portion 7*b* of the cover 7 entirely and neatly covers the peripheral edge 2*a* of the base plate 2, as is seen from FIG. 3.

Figure 4:
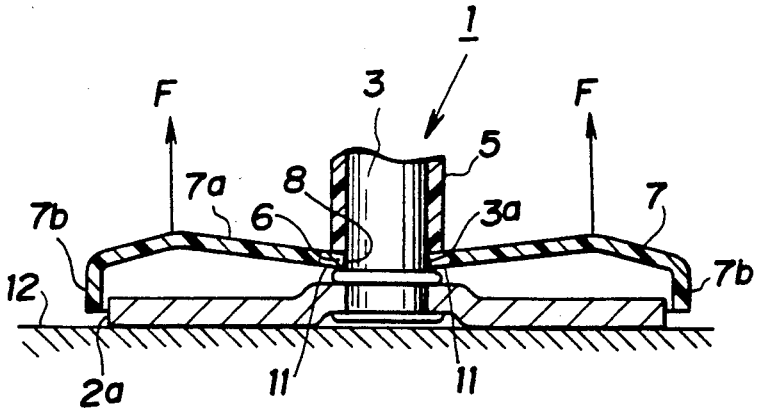
FIG. 4 is a view similar to FIG. 3, but showing a condition wherein a certain force is applied to the cover in a direction to separate the same from the lock striker.

As is understood from FIG. 4, even when a certain external force "F" is applied to the cover 7 in a direction to separate the cover 7 from the striker 1, the latched engagement of the tongues 11 of the cover 7 with the annular groove 6 of the striker 1 can suppress such undesired separation. Of course, when, for replacement of the cover 7, a marked force is applied, the cover 7 can be separated from the striker 1. Because, as is seen from FIG. 3, the side wall portion 7*b* of the cover 7 can entirely cover the peripheral edge 2*a* of the base plate 2 due to the dimensional relation expressed by "$L \geqq T$", the cover 7 is protected from catching the cloth of a passenger who is entering or leaving the vehicle. Furthermore, such whole covering protects the base plate 2 from water and dust.

Figure 5:
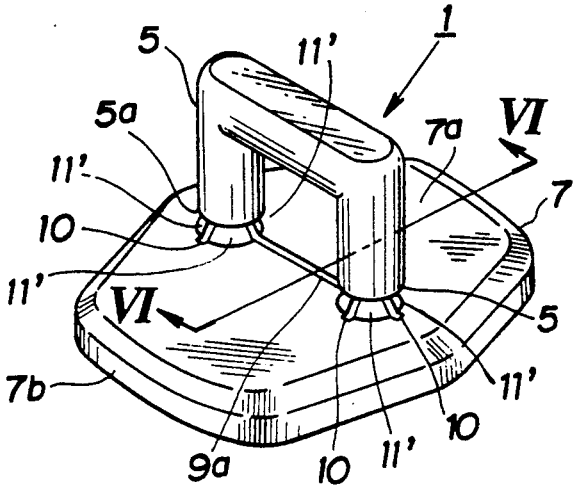
FIG. 5 is a view similar to FIG. 2, but showing a second embodiment of the present invention.
Figure 6:
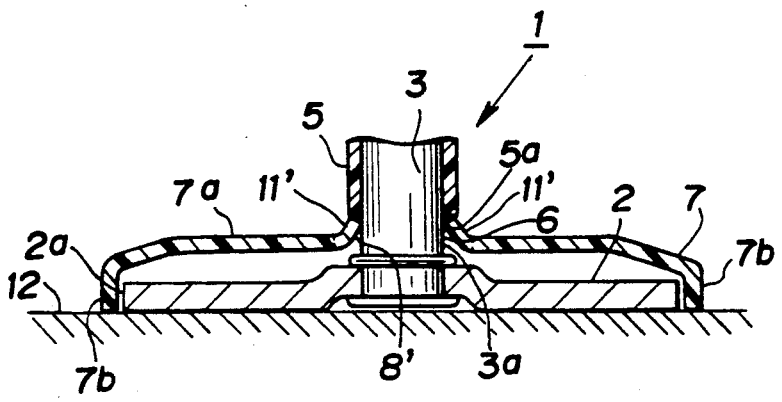
FIG. 6 is a sectional but partial view taken along the line VI—VI of FIG. 5.

Referring to FIGS. 5 and 6, there is shown a second embodiment of the present invention.

Since the second embodiment is similar in construction to the above-mentioned first embodiment, only parts and constructions which differ from those of the first embodiment will be described in the following and the substantially same parts are denoted by the same numerals in the drawings.

In this second embodiment, the diameter of each circular opening 8' formed in the cover 7 is somewhat smaller than that of the end portion 3*a* of the rod 3. Thus, as is best seen from FIG. 6, when the cover 7 is brought to its proper set position, the tongues 11' of each circular opening 8' are resiliently bent bringing their leading ends into abutment with a terminal end 5*a* of the plastic cover 5 of the rod 3. Thus, the cover 7 can be connected to the striker 1 without play.

Figure 7:
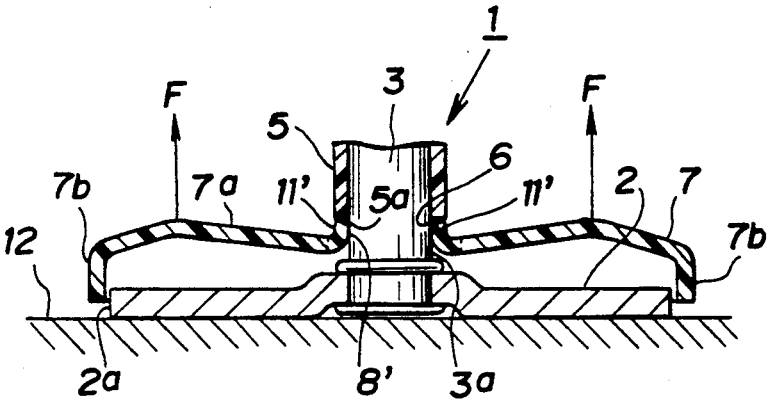
FIG. 7 is a view similar to FIG. 6, but showing a condition wherein a certain force is applied to the cover in a direction to separate the same from the lock striker.

As is understood from FIG. 7, when a certain external force "F" is applied to the cover 7 in a direction to separate the cover 7 from the striker 1, the leading ends of the tongues 11' are slid toward the base plate 2 due to the action of levers at the tongues 11', which strengthens the latched engagement of the tongues 11' with the annular groove 6 of the striker 1.

Figure 8:
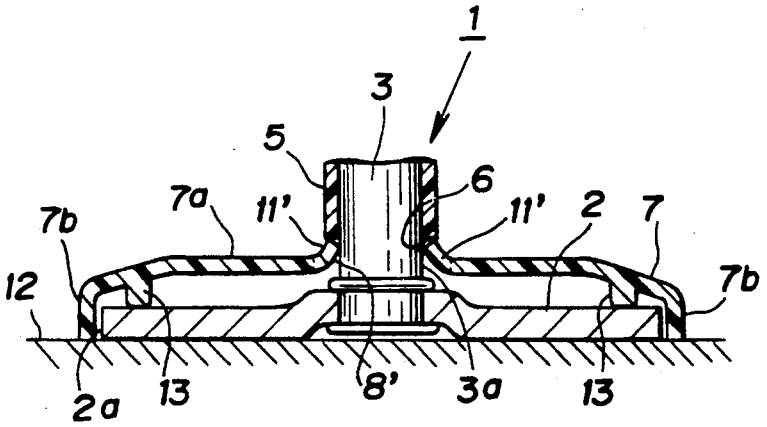
FIG. 8 is a view similar to FIG. 6, but showing a third embodiment of the present invention.

Referring to FIG. 8, there is shown a third embodiment of the present invention.

The cover 7 used in this third embodiment is substantially the same as the cover 7 of the above-mentioned second embodiment except for projections 13 which will be described in the following.

That is, in the third embodiment, a plurality of projections 13 are formed on a back surface of the cover 7. If desired, two projected ridges may be employed in place of the projections 13. Upon proper coupling of the cover 7 and the striker 1, the projections 13 abut on the upper surface of the base plate 2. Thus, the stable mounting of the cover 7 on the base plate 2 is much more assured.

In the following, advantages of the present invention will be described.

First, the mechanism for obtaining the latched engagement between the cover 7 and the striker 1 is very simple as compared with the mechanisms disclosed by the afore-mentioned publications. That is, in the present invention, there is no need of providing the base plate 2 of the striker 1 with notches which reduce the mechanical strength of the striker 1.

Second, even when an external force is applied to the cover 7 in a direction to separate the cover 7 from the striker 1, the latched engagement between the tongues 11' and the annular groove 6 can prevent the undesired separation with the aid of resilient deformation of the cover 7.

Third, because there is no need of providing the periphery of the cover 7 with latching pawls, the external appearance of the cover 7, and thus, that of the lock striker unit is not lowered. Because of the simple construction of the periphery of the cover 7, watertight and dusttight coupling is obtained between the cover 7 and the striker 1.

What is claimed is:

1. A lock striker unit for use with a lock device, said lock striker unit comprising:

a striker including a base plate, a rod having one end secured to said base plate and means for providing said rod with a diameterically larger shank portion and a diametrically smaller groove portion, said groove portion being positioned at said end of said rod; and a resilient cover having a size to cover a major surface of said base plate, said cover having an aperture surrounded by tongue portions defined by said cover, said aperture permitting said rod to pass therethrough and being so sized that when said shank portion is received in said aperture, said tongue portions are resiliently deformed by said shank portion, and when said groove portion is received in said aperture, said tongue portions make a latched engagement with said groove portion.

2. A lock striker unit as claimed in claim 1, in which said resilient cover is formed with a side wall portion which is sized to cover a peripheral edge of said base plate.

3. A lock striker unit as claimed in claim 2, in which said tongue portions are so sized as to freely expand in said groove portion when said groove portion is received in said aperture.

4. A lock striker unit as claimed in claim 2, in which said tongue portions are so sized as to be resiliently bent by said rod when said groove portion is received in said aperture.

5. A lock striker unit as claimed in claim 4, in which said cover is formed with a plurality of projections which abut against the major surface of said base plate when said cover is properly attached to said striker.

6. A lock striker unit for use with a lock device, said lock striker unit comprising:

a striker including a base plate, a generally U-shaped rod having two shank portions secured to said base plate at their leading ends, and covering means for providing each of said shank portions with a diametrically larger portion and a diametrically smaller groove portion, said groove portion being positioned at said leading end; and a resilient cover having a size to cover a major surface of said base plate, said cover having an elongate slit which is constructed to permit said rod to pass therethrough, wherein said elongate slit includes two circular openings connected through a thinner slit and spaced by a distance corresponding to the distance between said shank portions of said rod, each circular opening being surrounded by tongue portions defined by said cover and being so sized that when said diametrically larger portion of the shank portion is received in said circular opening, said tongue portions are resiliently deformed by said shank portion, and when said groove portion of the shank portion is received in said circular opening, said tongue portions make a latched engagement with said groove portion.

7. A lock striker unit as claimed in claim 6, in which said covering means is a plastic cover which covers said shank portion, and in which said resilient cover is constructed of a molded plastic.

8. A lock striker unit as claimed in claim 7, in which each of said tongue portions is bounded by two short slits which extend radially outward from the circular opening.

9. A lock striker unit as claimed in claim 8, in which said resilient cover is formed with a side wall portion which is sized to cover a peripheral edge of said base plate.

10. A lock striker unit as claimed in claim 9, in which the height of said side wall portion is substantially equal to the thickness of said peripheral portion of said base plate.

11. A lock striker unit as claimed in claim 7, in which said tongue portions of each circular opening are so sized as to freely expand in said groove portion when said groove portion is received in the corresponding circular opening.

12. A lock striker unit as claimed in claim 7, in which said tongue portions of each circular opening are so sized as to be resiliently bent by the corresponding shank portion when said groove portion is received in the corresponding circular opening.

13. A lock striker unit as claimed in claim 12, in which said resilient cover is formed with a plurality of projections which abut against the major surface of said base plate when said cover is properly attached to said striker.

* * * * *